US011769448B2

(12) United States Patent
Mi et al.

(10) Patent No.: US 11,769,448 B2
(45) Date of Patent: Sep. 26, 2023

(54) DISPLAY PANEL AND DISPLAY DEVICE

(71) Applicant: HEFEI VISIONOX TECHNOLOGY CO., LTD., Anhui (CN)

(72) Inventors: Lei Mi, Kunshan (CN); Hongqing Feng, Kunshan (CN); Jianjun Lu, Kunshan (CN)

(73) Assignee: HEFEI VISIONOX TECHNOLOGY CO., LTD., Hefei (CN)

( * ) Notice: Subject to any disclaimer, the term of this patent is extended or adjusted under 35 U.S.C. 154(b) by 0 days.

(21) Appl. No.: 18/070,892

(22) Filed: Nov. 29, 2022

(65) Prior Publication Data

US 2023/0096961 A1 Mar. 30, 2023

Related U.S. Application Data

(63) Continuation of application No. PCT/CN2021/106771, filed on Jul. 16, 2021.

(30) Foreign Application Priority Data

Oct. 29, 2020 (CN) ..... 202011180071.6

(51) Int. Cl.
*G09G 3/30* (2006.01)
*G09G 3/36* (2006.01)
*G09G 3/32* (2016.01)

(52) U.S. Cl.
CPC ..... *G09G 3/32* (2013.01); *G09G 2300/0465* (2013.01); *G09G 2310/0275* (2013.01); *G09G 2320/0247* (2013.01)

(58) Field of Classification Search
CPC ..... G09G 2300/04–0895; G09G 3/06; G09G 3/12; G09G 3/16–18; G09G 3/22–26; G09G 3/30–3493
See application file for complete search history.

(56) References Cited

U.S. PATENT DOCUMENTS

2005/0068288 A1 3/2005 Jang et al.
2006/0071884 A1* 4/2006 Kim ..... G09G 3/3233 345/76

(Continued)

FOREIGN PATENT DOCUMENTS

CN 104091569 A 10/2014
CN 104752468 A 7/2015

(Continued)

OTHER PUBLICATIONS

International Search Report dated Sep. 28, 2021, in International Patent Application No. PCT/CN2021/106771 (6 pages).

(Continued)

*Primary Examiner* — Sanghyuk Park
(74) *Attorney, Agent, or Firm* — Maier & Maier, PLLC

(57) ABSTRACT

A display device and a display panel including a first display region and a second display region. The light transmittance of the first display region is greater than the light transmittance of the second display region. At least one first display unit is disposed in the first display region. At least one second display unit, at least one drive unit, and at least one gating switch unit are disposed in the second display region. The at least one drive unit is connected to the input end of the at least one gating switch unit in a one-to-one manner. The first output end of each gating switch unit is connected to one of a first display unit and a second display unit and the second output end of the each gating switch unit is connected to the other one of the first display unit and the second display unit.

19 Claims, 7 Drawing Sheets

(56) References Cited

U.S. PATENT DOCUMENTS

| | | | | |
|---|---|---|---|---|
| 2016/0078826 | A1* | 3/2016 | Yoo | G09G 3/3648 345/88 |
| 2016/0148569 | A1* | 5/2016 | Park | G09G 3/3233 345/212 |
| 2019/0005889 | A1* | 1/2019 | Kwon | G09G 3/30 |

FOREIGN PATENT DOCUMENTS

| | | | |
|---|---|---|---|
| CN | 107610635 | A | 1/2018 |
| CN | 107633813 | A | 1/2018 |
| CN | 108399882 | A | 8/2018 |
| CN | 108490710 | A | 9/2018 |
| CN | 110189683 | A | 8/2019 |
| CN | 110232892 | A | 9/2019 |
| CN | 110459175 | A | 11/2019 |
| CN | 110534065 | A | 12/2019 |
| CN | 110767695 | A | 2/2020 |
| CN | 110783384 | A | 2/2020 |
| CN | 110942746 | A | 3/2020 |
| CN | 111128066 | A | 5/2020 |
| CN | 111261677 | A | 6/2020 |
| CN | 111430433 | A | 7/2020 |
| CN | 111768740 | A | 10/2020 |
| CN | 112289203 | A | 1/2021 |
| EP | 1594118 | A1 | 11/2005 |
| JP | 2002244619 | A | 8/2002 |
| JP | 2010191128 | A | 9/2010 |
| KR | 20100024079 | A | 3/2010 |

OTHER PUBLICATIONS

Office Action dated Jan. 13, 2022, in Chinese Application No. 202011180071.6 (16 pages).

* cited by examiner

DISPLAY PANEL AND DISPLAY DEVICE

CROSS-REFERENCE TO RELATED APPLICATIONS

This application is a continuation of International Patent Application No. PCT/CN2021/106771, filed on Jul. 16, 2021, which claims priority to Chinese Patent Application No. 202011180071.6 filed on Oct. 29, 2020, disclosures of both of which are incorporated herein by reference in their entireties.

TECHNICAL FIELD

Embodiments of the present application relate to the field of display technologies, for example, a display panel and a display device.

BACKGROUND

At present, display panels are developing in the direction of full screen. In the full screen, a light-transmissive region with a relatively large transmittance needs to be set in a display region. The light-transmissive region is configured to place structures such as a camera. In this case, pixel circuits in the light-transmissive region may be disposed in the peripheral region of the light-transmissive region, thereby ensuring the light transmittance of the light-transmissive region. When the pixel circuits are disposed in the peripheral region of the light-transmissive region, the pixels per inch (PPI) of the light-transmissive region can be reduced to reduce the number of pixel circuits disposed in the peripheral region, thereby reducing the occupied area of the peripheral region. In this case, the PPI of the light-transmissive region is different from the PPI of the display region, reducing the display effect of the display panel.

SUMMARY

The present application provides a display panel and a display device to improve the display effect of the display panel.

In a first aspect, an embodiment of the present application provides a display panel. The display panel includes a first display region and a second display region. The second display region is at least partially disposed around the first display region. The light transmittance of the first display region is greater than the light transmittance of the second display region.

At least one first display unit is disposed in the first display region. At least one second display unit, at least one drive unit, and at least one gating switch unit are disposed in the second display region. Each gating switch unit includes an input end, a first output end, and a second output end. The at least one drive unit is connected to the input end of the at least one gating switch unit in a one-to-one manner. The first output end of each gating switch unit is connected one of a first display unit and a second display unit and the second output end of the each gating switch unit is connected to the other one of the first display unit and the second display unit. Each gating switch unit is configured to gate the input end and the first output end of the gating switch unit, or gate the input end and the second output end of the gating switch unit in a time-division manner.

In a second aspect, an embodiment of the present application provides a display device including the display panel provided in any embodiment of the present application.

According to the technical solution of the embodiments of the present application, the first display unit is disposed in the first display region, and the second display unit, the drive unit, and the gating switch unit are disposed in the second display region. The drive unit is separately connected to the first display unit and the second display unit by the gating switch unit so that the drive unit can drive the first display unit and the second display unit in a time-division manner, thereby avoiding additionally setting the drive unit configured to drive the first display unit in the second display region. When the number of first display units in the first display region is relatively large, there is no need to increase the number of drive units in the second display region. Thus, the occupied area of the second display region can be avoided increasing, and the complexity of the circuit structure in the second display region is reduced, facilitating the design and preparation of the display panel. At the same time, the distribution density of first display units in the first display region may be increased so that the display effects of the first display region and the third display region are as similar as possible, thereby improving the overall display effect of the display panel.

DETAILED DESCRIPTION

Hereinafter the present application is described in detail in conjunction with the drawings and embodiments.

Figure 1:
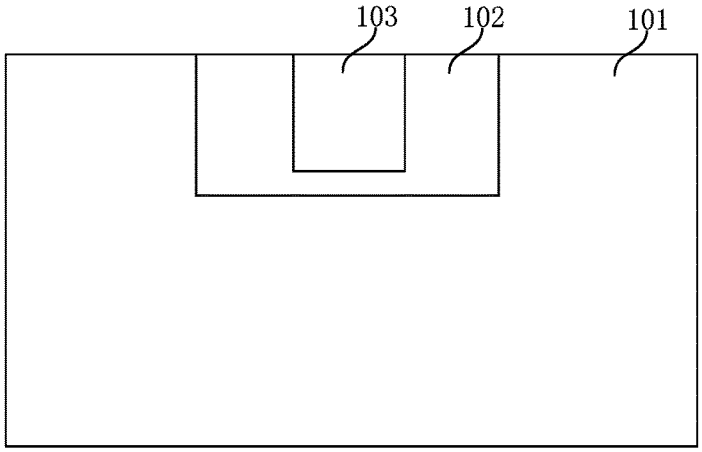
FIG. 1 is a diagram illustrating the structure of a display panel.

FIG. 1 is a diagram illustrating the structure of a display panel. As shown in FIG. 1, the display panel includes a conventional display region 101, a transition region 102, and a light-transmissive region 103. The transition region 102 is at least partially disposed around the light-transmissive region 103. The display region 101 is at least partially disposed around the transition region 102. The light transmittance of the light-transmissive region 103 is relatively high. The light-transmissive region 103 may be a camera region. When the display panel is displayed in full screen, a pixel unit which emits light normally is disposed in the conventional display region 101. A light emission element is disposed in the light-transmissive region 103. A pixel unit which emits light normally and a pixel circuit configured to drive the light emission element in the light-transmissive region 103 to emit light are disposed in the transition region 102. The light emission element in the light-transmissive region 103 is driven by the pixel circuit in the transition region 102 to emit light. When more light emission elements are disposed in the light-transmissive region 103, a relatively large number of pixel circuits corresponding to the light emission elements are disposed in the transition region 102. The structure of the transition region 102 is complex. The occupied area of the transition region 102 is relatively large. In this case, light emission elements in the light-transmissive region 103 may be reduced, that is, the pixels per inch (PPI) of the light-transmissive region 103 is reduced. For example, the PPI of the light-transmissive region 103 may be set to be one-half or three-quarters of the PPI of the conventional display region 101 so that the occupied area and the circuit design complexity of the transition region 102 can be reduced. However, the difference between the PPI of the light-transmissive region 103 and the PPI of the conventional display region 101 leads to different display effects in different regions when the display panel is displayed in full screen, thereby reducing the overall display effect of the display panel.

Figure 2:
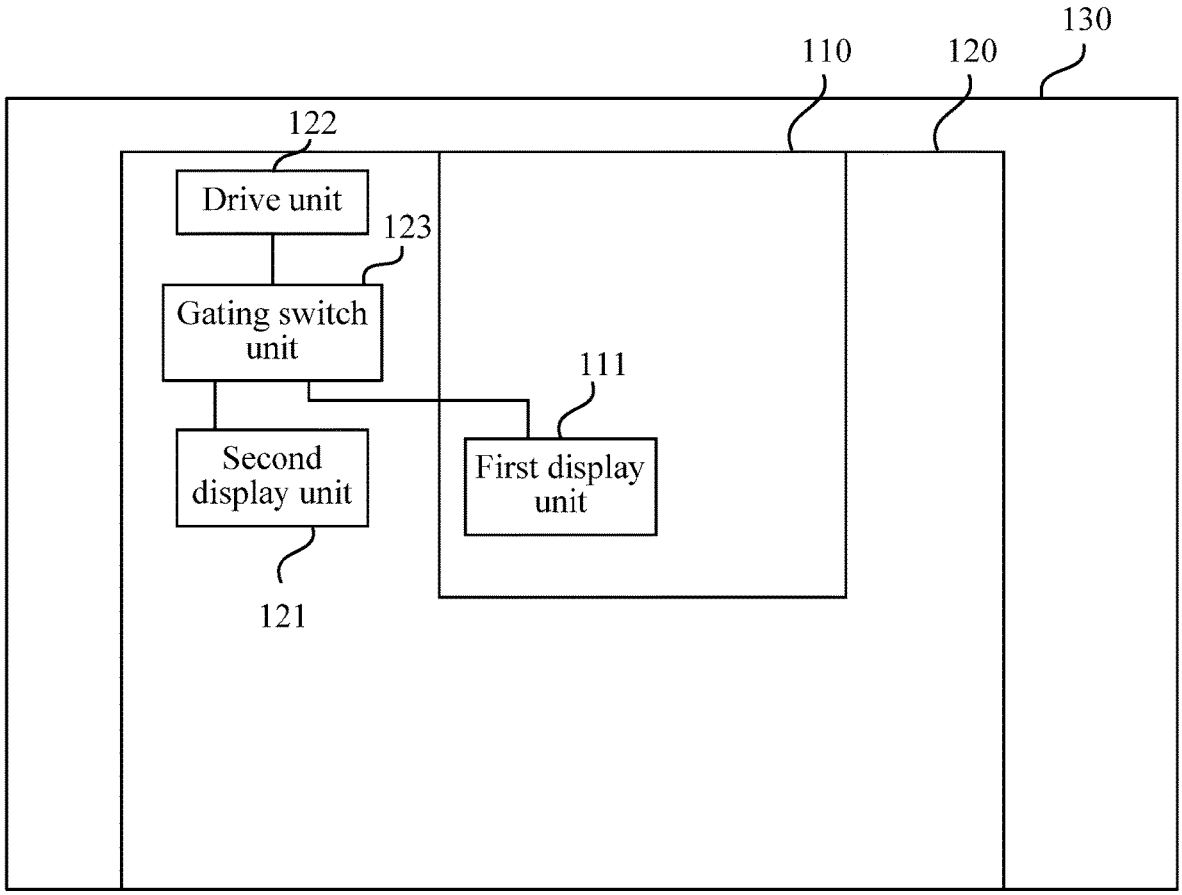
FIG. 2 is a diagram illustrating the structure of a display panel according to an embodiment of the present application.

An embodiment of the present application provides a display panel. FIG. 2 is a diagram illustrating the structure of a display panel according to an embodiment of the present application. As shown in FIG. 2, the display panel includes a first display region 110 and a second display region 120. The second display region 120 is at least partially disposed around the first display region 110. The light transmittance of the first display region 110 is greater than the light transmittance of the second display region 120. At least one first display unit 111 is disposed in the first display region 110. At least one second display unit 121, at least one drive unit 122, and at least one gating switch unit 123 are disposed in the second display region 120. Each gating switch unit 123 includes an input end, a first output end, and a second output end. At least one drive unit 122 is connected to the input end of the at least one gating switch unit 123 in a one-to-one manner. The first output end of each gating switch unit 123 is connected to one of a first display unit 111 and a second display unit 121 and the second output end of the each gating switch unit 123 is connected to the other one of the first display unit 111 and the second display unit 121. Each gating switch unit 123 is configured to gate the input end and the first output end of the gating switch unit 123 or to gate the input end and the second output end of the gating switch unit 123 in a time-division manner.

Exemplarily, the light transmittance of the first display region 110 is relatively large. Therefore, the first display region 110 may serve as a photosensitive region of the display panel, for example, a region corresponding to a camera. The region corresponding to a camera refers to a region where the camera is orthogonally projected on the display panel. The first display unit 111 may be a light emission element including a first electrode, a light emission layer, and a second electrode which are arranged in a stacked manner. Merely the first display unit 111 is disposed in the first display region 110. When the PPI of the first display region 110 is the same as the PPI of a third display region 130, the light transmittance of the first display region 110 can be ensured. The second display region 120 may include a transition region. The transition region is the transition region for the first display region 110 and a conventional display region. The display panel may include a third display region 130. The third display region 130 as a conventional display region of the display panel is at least partially disposed around the second display region 120. In the third display region 130, a display unit and a pixel circuit correspondingly connected to the display unit may be disposed. The pixel circuit drives the display unit correspondingly connected to the pixel circuit to emit light. The second display region 120 includes the drive unit 122. The drive signal output by the drive unit 122 can drive the first display unit 111 and the second display unit 121 in a time-division manner according to the gating state of the gating switch unit 123 to emit light. Exemplarily, the first output end of the gating switch unit 123 is connected to the first display unit 111, and the second output end of the gating switch unit 123 is connected to the second display unit 121. When the gating switch unit 123 gates the input end and the first output end of the gating switch unit 123 for a period of time, the drive signal provided by the drive unit 122 is output to the first display unit 111 through the first output end to drive the first display unit 111 to emit light. When the gating switch unit 123 gates the input end and the second output end of the gating switch unit 123 for a period of time, the drive signal provided by the drive unit 122 is output to the second display unit 121 through the second output end to drive the second display unit 121 to emit light. It can be seen from the above that the drive unit 122 in the second display region 120 can drive the first display unit 111 and the second display unit 121 in a time-division manner. In the second display region 120, the first display unit 111 multiplexes the drive unit 122 of the second display unit 121, and a drive unit configured to drive the first display unit 111 does not need to be set additionally. When the number of first display units 111 in the first display region 110 is relatively large, there is no need to increase the number of drive units 122 in the second display region 120. Thus, the occupied area of the second display region 120 can be avoided increasing, and the complexity of the circuit structure in the second display region 120 is reduced, facilitating the design and preparation of the display panel. At the same time, the distribution density of first display units 111 in the first display region 110 may be increased so that the display effects of the first display region 110 and the third display region 130 are as similar as possible, thereby improving the overall display effect of the display panel. Exemplarily, the distribution density of first display units 111 in the first display region 110 may be set to be the same as the PPI of the third display region 130 so that the display effects of the first display region 110 and the third display region 130 are as similar as possible, improving the overall display effect of the display panel.

The drive unit 122 may be any type of pixel circuit. Exemplarily, FIG. 2 is a diagram illustrating the structure of a pixel circuit according to an embodiment of the present application. As shown in FIG. 2, the drive unit 122 may be a 7T1C pixel circuit.

It is to be noted that when the drive unit 122 drives the first display unit 111 and the second display unit 121 in a time-division manner, the light emission time of the first display unit 111 is less than the light emission time of a pixel unit in the third display region 130. When the luminous brightness of the first display unit 111 is the same as the luminous brightness of the pixel unit in the third display region 130, the overall display luminous brightness of the first display region 110 is less than the overall display luminous brightness of the third display region 130. Therefore, it is possible to set the luminous brightness of first display units 111 in the first display region 110 to be greater than the luminous brightness of the pixel units in the third display region 130 and improve the overall display luminous brightness of the first display region 110, thereby improving the overall display effect of the display panel. Exemplarily, the driving unit 122 drives the second display unit 121 to emit light in odd-numbered frames and drives the first display unit 111 to emit light in even-numbered frames. The light emission time of the first display unit 111 is half of the light emission time of the pixel unit in the third display region 130. At this time, the drive signal of the first display unit 111 may be adjusted so that the luminous brightness of the first display unit 111 is twice the luminous brightness of the pixel unit in the third display region 130. Thus, the overall luminous brightness of the first display region 110 is substantially the same as the overall luminous brightness of the third display region 130, improving the overall display effect of the display panel.

Optionally, each gating switch unit 123 is switched from gating the input end and the first output end to gating the input end and the second output end, or from gating the input end and the second output end to gating the input end and the first output end between frames.

The gating switch unit 123 can switch a gating path in a vertical blanking interval between frames. The vertical blanking interval is the time interval during which the scanning point of the display panel needs to return to the upper left corner of the image from the lower right corner of the image after scanning one frame to start a new frame of scanning. When the gating switch unit 123 switches the gating path, the on state between the input end and the first output end of the gating switch unit 123 may be switched to the on state between the input end and the second output end of the gating switch unit 123, or the on state between the input end and the second output end of the gating switch unit 123 may be switched to the on state between the input end and the first output end of the gating switch unit 123. For example, in the current frame, the input end and the first output end of the gating switch unit 123 are turned on. In the vertical blanking interval between the current frame and the next frame, the input end and the second output end of the gating switch unit 123 are switched to be turned on. Alternatively, in the current frame, the input end and the second output end of the gating switch unit 123 are turned on. In the vertical blanking interval between the current frame and the next frame, the input end and the first output end of the gating switch unit 123 are switched to be turned on. By switching the gating path of the gating switch unit 123 between frames, the state of the gating switch unit 123 remains unchanged in one frame. The drive unit 122 is relatively stable when driving the first display unit 111 or the second display unit 121 to emit light, thereby ensuring that the first display unit 111 or the second display unit 121 emits light normally.

It is to be noted that when the gating switch unit 123 switches the path of the gating switch unit 123 between frames, the switch may be performed between every two adjacent frames or between multiple frames. Optionally, the gating switch unit 123 switches path between every two adjacent frames so that the first display unit 111 and the second display unit 121 emit light in odd-numbered frames and even-numbered frames, respectively, thereby improving the overall display effect of the display panel.

Figure 3:
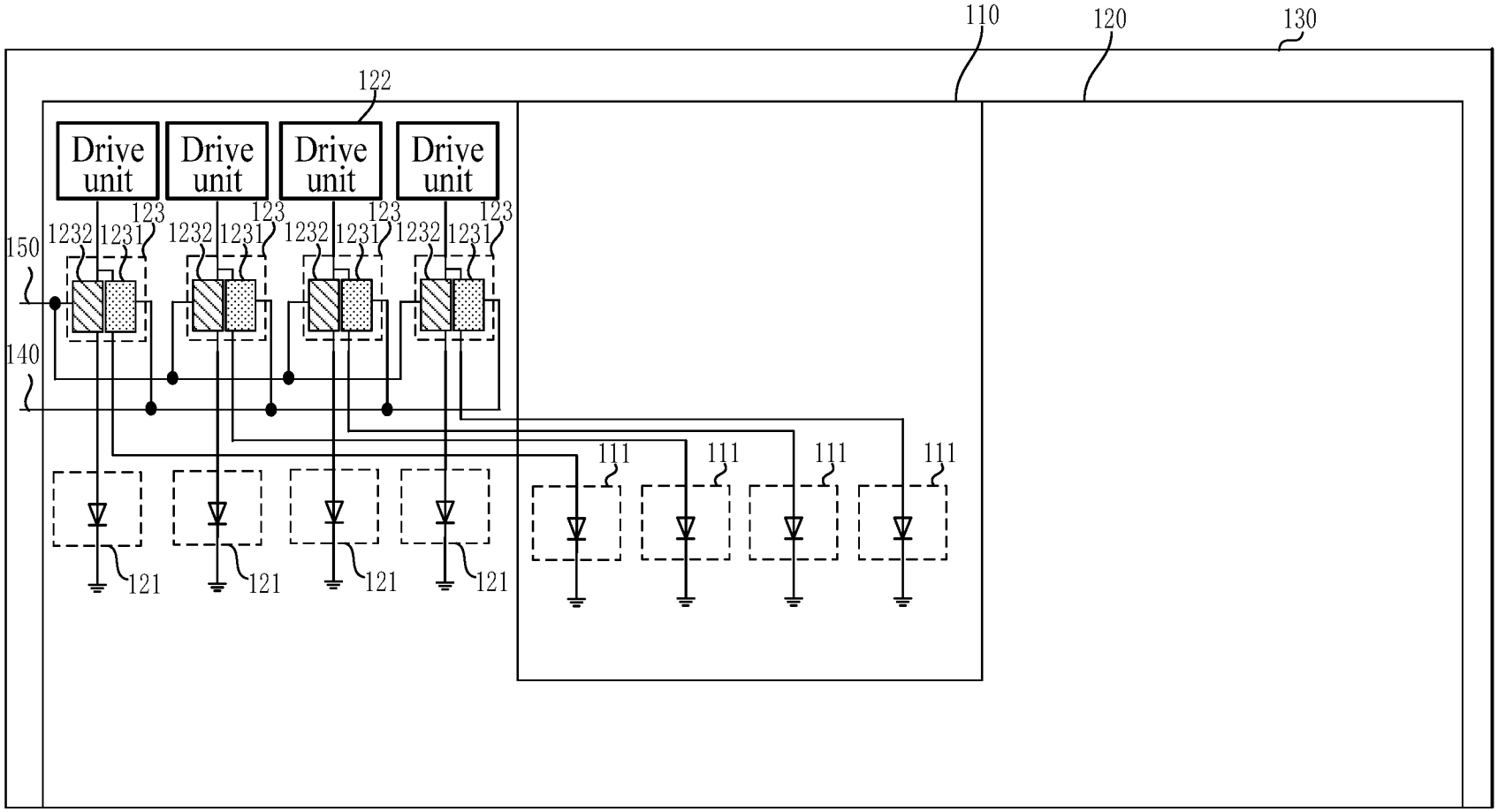
FIG. 3 is a diagram illustrating the structure of another display panel according to an embodiment of the present application.

FIG. 3 is a diagram illustrating the structure of another display panel according to an embodiment of the present application. As shown in FIG. 3, the display panel includes a first control signal line 140 and a second control signal line 150. Each gating switch unit 123 includes a first switch subunit 1231 and a second switch subunit 1232. The first end of the first switch subunit 1231 and the first end of the second switch subunit 1232 are connected to a drive unit 122. The second end of the first switch subunit 1231 is connected to a first display unit 111. The control end of the first switch subunit 1231 is connected to the first control signal line 140. The second end of the second switch subunit 1232 is connected to the second display unit 121. The control end of the second switch subunit 1232 is connected to the second control signal line 150.

The first end of the first switch subunit 1231 and the first end of the second switch subunit 1232 serve as the input end of the gating switch unit 123. The second end of the first switch subunit 1231 may serve as the first output end of the gating switch unit 123. The second end of the second switch subunit 1232 may serve as the second output end of the gating switch unit 123. The first control signal line 140 provides a first control signal to control the first switch subunit 1231 to be turned on or off. When the first switch subunit 1231 is turned on and the second switch subunit 1232 is turned off, the input end and the first output end of the gating switch unit 123 are turned on, and the input end and the second output end of the gating switch unit 123 are turned off. That is, the gating switch unit 123 gates the input end and the first output end. When the first switch subunit 1231 is turned off and the second switch subunit 1232 is turned on, the input end and the first output end of the gating switch unit 123 are turned off, and the input end and the second output end of the gating switch unit 123 are turned on. That is, the gating switch unit 123 gates the input end and the second output end. In the process of driving display units by drive units 122, an example in which the gating switch unit 123 switches the gating path between every two adjacent frames is described.

In the current frame, the first control signal provided by the first control signal line 140 controls the first switch subunit 1231 to be turned on. When the second control signal provided by the second control signal line 150 controls the second switch subunit 1232 to be turned off, the drive signal provided by the drive unit 122 drives the first display unit 111 to emit light. After the end of the current frame, in the vertical blanking interval between the current frame and the next frame, the gating switch unit 123 switches the gating path. The first control signal provided by the first control signal line 140 controls the first switch subunit 1231 to be turned off, and the second control signal provided by the second control signal line 150 controls the second switch subunit 1232 to be turned on. In the next frame, the drive signal provided by the drive unit 122 drives the second display unit 121 to emit light. It can be seen from the above that the drive unit 122 drives the first display unit 111 and the second display unit 121 to emit light in a time-division manner, thereby avoiding additionally setting the drive unit configured to drive the first display unit 111 in the second display region 120. When the number of first display units 111 in the first display region 110 is relatively large, the number of drive units 122 in the second display region 120 does not need to be increased. Thus, the occupied area of the second display region 120 can be avoided increasing, and the complexity of the circuit structure in the second display region 120 is reduced, facilitating the design and preparation of the display panel. At the same time, the distribution density of first display units 111 in the first display region 110 may be increased so that the display effects of the first display region 110 and the third display region 130 are as similar as possible, thereby improving the overall display effect of the display panel.

Figure 4:
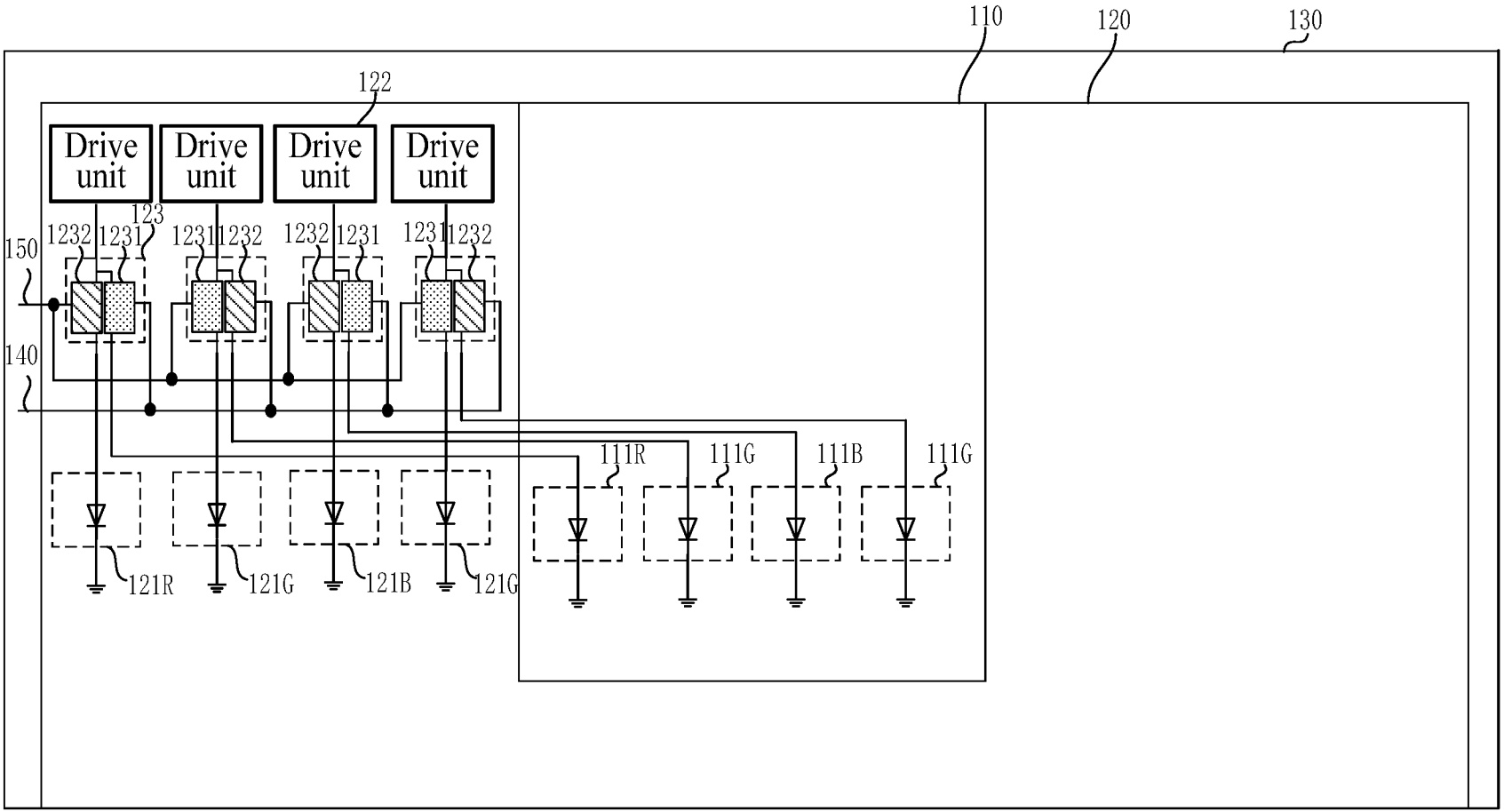
FIG. 4 is a diagram illustrating the structure of another display panel according to an embodiment of the present application.

FIG. 4 is a diagram illustrating the structure of another display panel according to an embodiment of the present application. As shown in FIG. 4, the display panel includes a first control signal line 140 and a second control signal line 150. Each gating switch unit 123 includes a first switch subunit 1231 and a second switch subunit 1232. The first end of each first switch subunit 1231 and the first end of each second switch subunit 1232 are connected to a drive unit 122. The control end of each first switch subunit 1231 is connected to the first control signal line 140. Second ends of i first switch subunits 1231 are connected to first display units 111. Second ends of (n−i) first switch subunits 1231 are connected to second display units 121. The control end of each second switch subunit 1232 is connected to the second control signal line 150. Second ends of (n−i) second switch subunits 1232 are connected to the first display units 111. Second ends of i second switch subunits 1232 are connected to the second display units 121. i is an integer greater than or equal to 1 and less than n. n is the number of the first display units 111.

The number of first display units 111, the number of second display units 121, and the number of gating switch units 123 and drive units 122 connected to the first display units 111 and the second display units 121 in a one-to-one manner are all equal. When the display panel includes multiple first display units 111 and multiple second display units 121, the first control signal provided by the first control signal line 140 controls all first switch subunits 1231 to be simultaneously turned on or off, and the second control signal provided by the second control signal line 150 controls all second switch subunits 1232 to be simultaneously turned on or off. In the process of driving display units by drive units 122, when the first control signal provided by the first control signal line 140 controls first switch subunits 1231 to be turned on and the second control signal provided by the second control signal line 150 controls second switch subunits 1232 to be turned off, part of first display units 111 connected to second ends of the first switch subunits 1231 and part of second display units 121 connected to second ends of the first switch subunits 1231 emit light, and part of the first display units 111 connected to second ends of the second switch subunits 1232 and part of the second display units 121 connected to second ends of the second switch subunits 1232 do not emit light. When the first control signal provided by the first control signal line 140 controls the first switch subunits 1231 to be turned off and the second control signal provided by the second control signal line 150 controls the second switch subunits 1232 to be turned on, the part of the first display units 111 connected to the second ends of the first switch subunits 1231 and the part of the second display units 121 connected to the second ends of the first switch subunits 1231 do not emit light, and the part of the first display units 111 connected to the second ends of the second switch subunits 1232 and the part of the second display units 121 connected to the second ends of the second switch subunits 1232 emit light. It can be seen from the above that in each frame, the first display units 111 in the first display region 110 and the second display units 121 in the second display region 120 both partially emit light and partially do not emit light. Therefore, the flicker problem caused by only the first display units 111 emitting light or only the second display units 121 emitting light in one frame can be avoided.

Exemplarily, as shown in FIG. 4, the first display units 111 include three color display units which are a first red display unit 111R, first green display units 111 G, and a first blue display unit 111B. The second display units 121 include three color display units which are a second red display unit 121R, second green display units 121G, and a second blue display unit 121B. The red display unit can emit red light. The green display units can emit green light. The blue display unit can emit blue light. One or two color display units of the first display units 111 are connected to the second ends of the first switch subunits 1231. Two or one color display unit of the second display units 121 is connected to the second end of the first switch subunit 1231. The color display units of the first display units 111 connected to the second ends of the first switch subunits 1231 are different from the color display units of the second display units 121 connected to the second ends of the first switch subunits 1231. All kinds of color display units of the display units are included. Meanwhile, another two or one color display unit of the first display units 111 is connected to the second end of the second switch subunit 1232. Another one or two color display units of the second display units 121 are connected to the second ends of the second switch subunits 1232. For example, the first red display unit 111R and the first blue display unit 111B are connected to the second ends of the first switch subunits 1231, and the second green display units 121G are connected to the second ends of the first switch subunits 1231. Meanwhile, the first green display units 111G are connected to the second ends of the second switch subunits 1232, and the second red display unit 121R and the second blue display unit 121B are connected to the second ends of the second switch subunits 1232. In the process of driving display units by drive units 122, an example in which the gating switch unit 123 switches the gating path between every two adjacent frames is described.

In the current frame, the first control signal provided by the first control signal line 140 controls the first switch subunits 1231 to be turned on. When the second control signal provided by the second control signal line 150 controls the second switch subunits 1232 to be turned off, the drive signal provided by the drive units 122 drives the first red display unit 111R, the first blue display unit 111B, and the second green display units 121G to emit light. After the end of the current frame, in the vertical blanking interval between the current frame and the next frame, the gating switch unit 123 switches the gating path. The first control signal provided by the first control signal line 140 controls the first switch subunits 1231 to be turned off, and the second control signal provided by the second control signal line 150 controls the second switch subunits 1232 to be turned on. In the next frame, the drive signal provided by the drive units 122 drives the first green display units 111G, the second red display unit 121R, and the second blue display unit 121B to emit light. It can be seen from the above that in each frame, the first display units 111 in the first display region 110 and the second display units 121 in the second display region 120 both partially emit light and partially do not emit light. Therefore, the flicker problem caused by only the first display units 111 emitting light or only the second display units 121 emitting light in one frame can be avoided. In each frame, the display units that emit light in the first display units 111 and the second display units 121 include all kinds of color display units and can be mixed into light of any color to ensure normal light emission of the display panel.

Referring to FIG. 4, the first display units 111 include at least one color display unit, and the second display units 121 include at least one color display unit. The types of color display units of the first display units 111 are same as the types of color display units of the second display units 121. The color display units with the same type in the first display units 111 and the second display units 121 are connected to the same drive unit 122.

Exemplarily, as shown in FIG. 4, the first display units 111 include three color display units which are the first red display unit 111R, the first green display units 111G, and the first blue display unit 111B. The second display units 121 include three color display units which are the second red display unit 121R, the second green display units 121G, and the second blue display unit 121B. The same drive unit 122 is separately connected to a display unit of the same color in the first display region 110 and the second display region 120 through a gating switch unit 123. For example, a drive unit 122 is connected to the first red display unit 111R by a first switch subunit 1231, and the same drive unit 122 is connected to the second red display unit 121R by a second switch subunit 1231 in the same gating switch unit 123. Alternatively, a drive unit 122 is connected to the second red display unit 121R by a first switch subunit 1231, and the same drive unit 122 is connected to the first red display unit 111R by a second switch subunit 1231 in the same gating switch unit 123. Similarly, a drive unit 122 is connected to a first green display unit 111G by a first switch subunit 1231, and the same drive unit 122 is connected to a second green display unit 121G by a second switch subunit 1231 in the same gating switch unit 123. Alternatively, a drive unit 122 is connected to a second green display unit 121G by a first switch subunit 1231, and the same drive unit 122 is connected to a first green display unit 111G by a second switch subunit 1231 in the same gating switch unit 123. A drive unit 122 is connected to the first blue display unit 111B by a first switch subunit 1231, and the same drive unit 122 is connected to the second blue display unit 121B by a second switch subunit 1231 in the same gating switch unit 123. Alternatively, a drive unit 122 is connected to the second blue display unit 121B by a first switch subunit 1231, and the same drive unit 122 is connected to the first blue display unit 111B by a second switch subunit 1231 in the same gating switch unit 123. The same drive unit 122 is connected to the same color display unit of the first display units 111 and the second display units 121, thereby simplifying the complexity of the drive units 122 to drive the first display units 111 and the second display units 121 in a time-division manner, reducing the difficulty of driving the display panel, and facilitating the design and implementation of the display panel.

Figure 5:
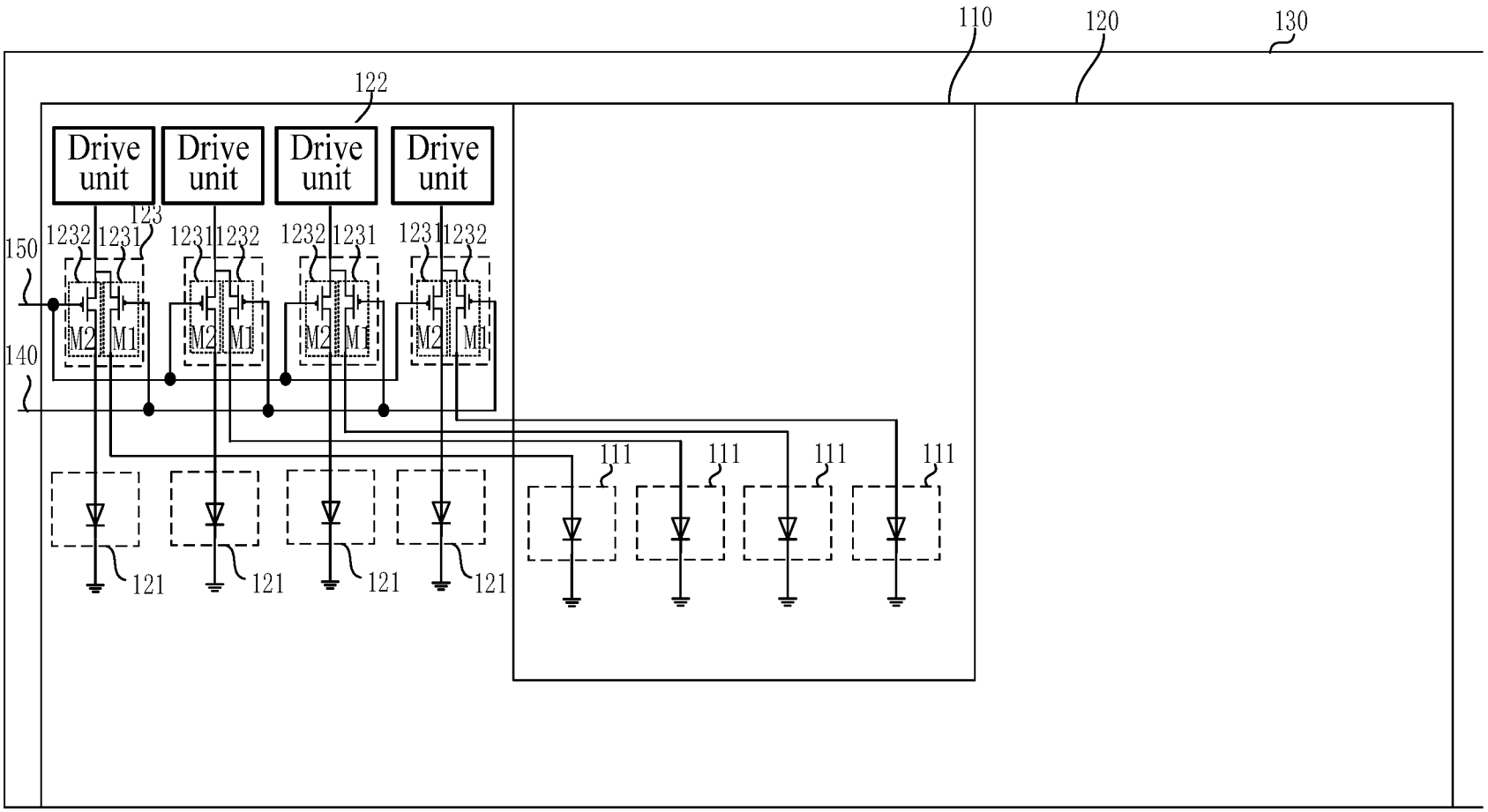
FIG. 5 is a diagram illustrating the structure of another display panel according to an embodiment of the present application.

FIG. 5 is a diagram illustrating the structure of another display panel according to an embodiment of the present application. As shown in FIG. 5, the display panel includes a first control signal line 140 and a second control signal line 150. Each gating switch unit 123 includes a first switch subunit 1231 and a second switch subunit 1232. The array arrangement of first display units 111 is the same as the array arrangement of second display units 121. The first end of the first switch subunit 1231 and the first end of the second switch subunit 1232 are connected to a drive unit. The control end of each first switch subunit 1231 is connected to the first control signal line 140. The control end of each second switch subunit 1232 is connected to the second control signal line 150. The first display units 111 in the odd-numbered column are connected to the second ends of the corresponding first switch subunits 1231. The first display units 111 in the even-numbered column are connected to the second ends of the corresponding second switch subunits 1232. The second display units 121 in the odd-numbered column are connected to the second ends of the corresponding second switch subunits 1232. The second display units 121 in the even-numbered column are connected to the second ends of the corresponding first switch subunits 1231. Alternatively, the first display units 111 in the even-numbered column are connected to the second ends of the corresponding first switch subunits 1231. The first display units 111 in the odd-numbered column are connected to the second ends of the corresponding second switch subunits 1232. The second display units 121 in the even-numbered column are connected to the second ends of the corresponding second switch subunits 1232. The second display units 121 in the odd-numbered column are connected to the second ends of the corresponding first switch subunits 1231.

As shown in FIG. 5, the display panel exemplarily shows that the first display units 111 in the odd-numbered column are connected to the second ends of the corresponding first switch subunits 1231, the first display units 111 in the even-numbered column are connected to the second ends of the corresponding second switch subunits 1232, the second display units 121 in the odd-numbered column are connected to the second ends of the corresponding second switch subunits 1232, and the second display units 121 in the even-numbered column are connected to the second ends of the corresponding first switch subunits 1231. In the process of driving display units by drive units 122, when the first control signal provided by the first control signal line 140 controls first switch subunits 1231 to be turned on and the second control signal provided by the second control signal line 150 controls second switch subunits 1232 to be turned off, the drive units 122 drive the first display units 111 in the odd-numbered column and the second display units 121 in the even-numbered column to emit light. The first display units 111 in the even-numbered column and the second display units 121 in the odd-numbered column do not emit light. When the first control signal provided by the first control signal line 140 controls first switch subunits 1231 to be turned off and the second control signal provided by the second control signal line 150 controls second switch subunits 1232 to be turned on, the drive units 122 drive the first display units 111 in the even-numbered column and the second display units 121 in the odd-numbered column to emit light. The first display units 111 in the odd-numbered column and the second display units 121 in the even-numbered column do not emit light. It can be seen from the above that in each frame, the first display units 111 in the first display region 110 and the second display units 121 in the second display region 120 emit light in separate columns. Therefore, the flicker problem caused by only the first display units 111 emitting light or only the second display units 121 emitting light in one frame can be avoided.

In other embodiments, the first display units 111 in the even-numbered column are connected to the second ends of the corresponding first switch subunits 1231, the first display units 111 in the odd-numbered column are connected to the second ends of the corresponding second switch subunits 1232, the second display units 121 in the even-numbered column are connected to the second ends of the corresponding second switch subunits 1232, and the second display units 121 in the odd-numbered column are connected to the second ends of the corresponding first switch subunits 1231. It can also be implemented that in each frame, the first display units 111 in the first display region 110 and the second display units 121 in the second display region 120 emit light in separate columns Therefore, the flicker problem caused by only the first display units 111 emitting light or only the second display units 121 emitting light in one frame can be avoided.

Referring to FIG. 5, the first switch subunit 1231 includes a first switch transistor M1, and the second switch subunit 1232 includes a second switch transistor M2. The channel type of the first switch transistor M1 and the channel type of the second switch transistor M2 are the same.

Figure 6:
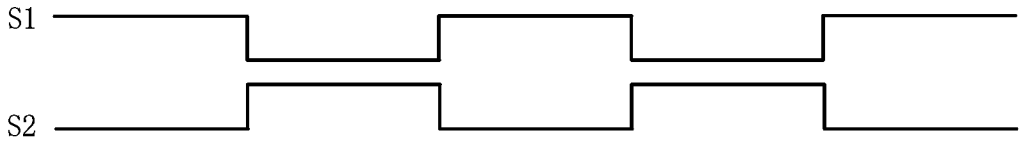
FIG. 6 is a timing diagram of a first control signal provided by a first control signal line and a second control signal provided by a second control signal line in the display panel in FIG. 5.

FIG. 5 exemplarily shows that the first switch transistor M1 and the second switch transistor M2 are P-type transistors. In other embodiments, the first switch transistor M1 and the second switch transistor M2 may be N-type transistors. When the channel type of the first switch transistor 140 and the channel type of the second switch transistor 150 are the same, the level of the first control signal provided by the first control signal line 140 and the level of the second control signal provided by the second control signal line 150 are opposite. Thus, a timing error of the first control signal and the second control signal can be prevented from causing a display abnormality of the first display units 111 and the second display units 121, thereby improving the reliability of the normal display of the first display region 110 and the second display region 120. Exemplarily, FIG. 6 is a timing diagram of the first control signal provided by the first control signal line and the second control signal provided by the second control signal line in the display panel in FIG. 5. S1 is the timing of the first control signal. S2 is the timing of the second control signal. As shown in FIG. 6, the level of the first control signal S1 and the level of the second control signal S2 are opposite to improve the reliability of the normal display of the first display region 110 and the second display region 120.

Optionally, in the same vertical blanking interval, the time when first switch subunits are turned on lags behind the time when second switch subunits are turned off. Alternatively, the time when the second switch subunits are turned on lags behind the time when first switch subunits are turned off.

Figure 7:
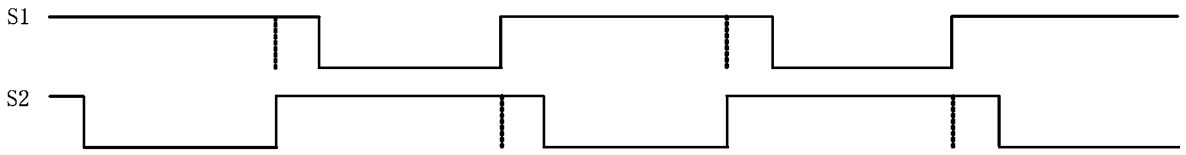
FIG. 7 is a timing diagram of a first control signal provided by a first control signal line and a second control signal provided by a second control signal line according to an embodiment of the present application.

In the process of driving display units by drive units, before gating switch units switch paths between frames, when the first control signal provided by a first control signal line controls first switch subunits to be turned on and the second control signal provided by a second control signal line controls second switch subunits to be turned off, drive signals in the drive units drive the display units connected to second ends of the first switch subunits to emit light. In this case, the drive signals provided by the drive units are formed according to the data signals of the display units connected to second ends of the first switch subunits. After the gating switch units switch paths between frames, when the first control signal provided by the first control signal line controls the first switch subunits to be turned off and the second control signal provided by the second control signal line controls the second switch subunits to be turned on, before the drive units write data signals of the display units connected to the second ends of the second switch subunits, the drive signals in the drive units do not change and are the residual data signals of the previous frame, and problems such as afterimage easily occur. In this case, the time when the first switch subunits are turned on can be set to lag behind the time when the second switch subunits are turned off so that the drive units first write the data signals of the display units connected to the second ends of the second switch subunits. Then, the second control signal provided by the second control signal line controls the second switch subunits to be turned on, thereby avoiding problems such as afterimage occurring in the display units connected to the second ends of the second switch subunits, and improving the display effect of the display panel. Similarly, after the gating switch units switch paths between frames, when the first control signal provided by the first control signal line controls the first switch subunits to be turned on and the second control signal provided by the second control signal line controls the second switch subunits to be turned off, the time when the first switch subunits are turned on lags behind the time when the second switch subunits are turned off. In this manner, problems such as afterimage occurring in the display units connected to the second ends of the first switch subunits can be avoided, and the display effect of the display panel is improved. Exemplarily, when the channel type of the first switch transistor and the channel type of the second switch transistor are the same, FIG. 7 is a timing diagram of a first control signal provided by a first control signal line and a second control signal provided by a second control signal line according to an embodiment of the present application. S1 is the timing of the first control signal. S2 is the timing of the second control signal. As shown in FIG. 7, the time when the first control signal hops from the high level to the low level lags behind the time when the second control signal hops from the low level to the high level, and the time when the second control signal hops from the high level to the low level lags behind the time when the first control signal hops from the low level to the high level.

Figure 8:
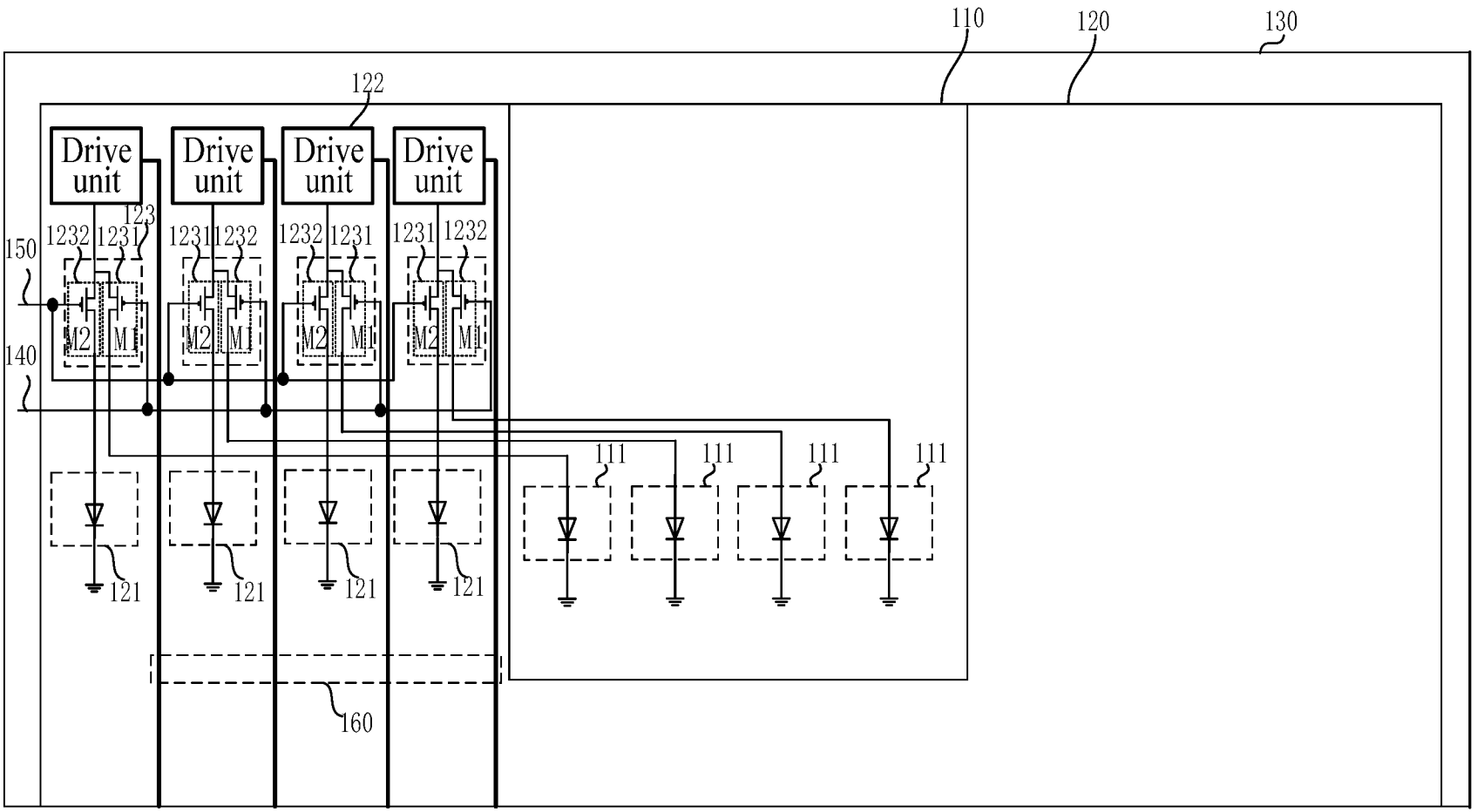
FIG. 8 is a diagram illustrating the structure of another display panel according to an embodiment of the present application.

FIG. 8 is a diagram illustrating the structure of another display panel according to an embodiment of the present application. As shown in FIG. 8, the display panel includes at least one data line 160. The at least one data line 160 is connected to at least one drive unit 122 in a one-to-one manner. The data line 160 is configured to provide a first data signal and a second data signal to the drive unit 122 in a time-division manner.

The drive unit 122 includes a data signal input end connected to the data line 160. The data signal input end is configured to write the data signal provided by the data line 160 in the data write stage of the drive unit 122. When the drive unit 122 drives a first display unit 111 to emit light, the data line 160 may provide a first data signal for the drive unit 122 so that the first display unit 111 emits light according to the first data signal. When the drive unit 122 drives s second display unit 121 to emit light, the data line 160 may provide a second data signal for the drive unit 122 so that the second display unit 121 emits light according to the second data signal. Since the display grayscale and luminous brightness of the first display unit 111 and the second display unit 121 may be the same or different, the first data signal and the second data signal may be equal or unequal. In the preceding process, when the data line 160 provides the data signal for the first display unit 111 and the second display unit 121 in a time-division manner, the data signal can be converted by the driver chip in the display panel and transmitted to the drive unit 122 through the data line 160 in the display panel.

Figure 9:
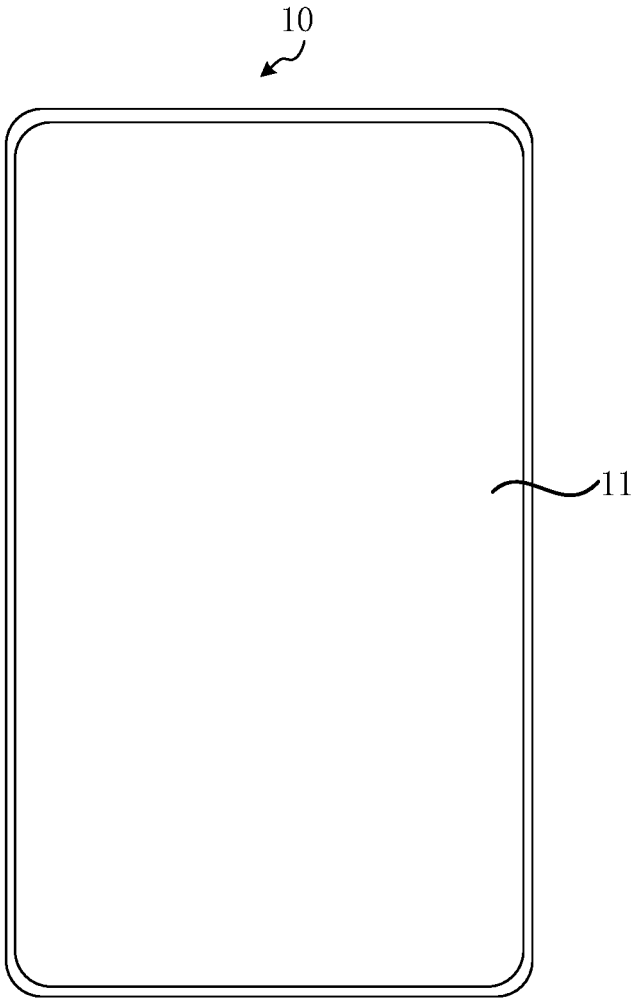
FIG. 9 is a diagram illustrating the structure of a display device according to an embodiment of the present application.

An embodiment of the present application provides a display device. FIG. 9 is a diagram illustrating the structure of a display device according to an embodiment of the present application. As shown in FIG. 9, a display device 10 includes the display panel 11 provided by any embodiment of the present application.

What is claimed is:

1. A display panel, comprising a first display region and a second display region, wherein the second display region is at least partially disposed around the first display region, and a light transmittance of the first display region is greater than a light transmittance of the second display region;

at least one first display unit is disposed in the first display region, and at least one second display unit, at least one drive unit, and at least one gating switch unit are disposed in the second display region, each gating switch unit comprises an input end, a first output end, and a second output end, the at least one drive unit is connected to an input end of the at least one gating switch unit in a one-to-one manner, and the first output end of each gating switch unit is connected to one of a first display unit and a second display unit, and the second output end of the each gating switch unit is connected to the other one of the first display unit and the second display unit; and each gating switch unit is configured to gate the input end and the first output end of the each gating switch unit, or gate the input end and the second output end of the each gating switch unit in a time-division manner.

2. The display panel according to claim 1, wherein the each gating switch unit is switched from gating the input end and the first output end to gating the input end and the second output end, or from gating the input end and the second output end to gating the input end and the first output end between frames.

3. The display panel according to claim 2, wherein the each gating switch unit switches a gating path in a vertical blanking interval between frames.

4. The display panel according to claim 2, wherein the each gating switch unit switches between every two adjacent frames or every a plurality of frames when switching a path of the each gating switch unit between frames.

5. The display panel according to claim 1, further comprising a first control signal line and a second control signal line, wherein the each gating switch unit comprises a first switch subunit and a second switch subunit; and a first end of the first switch subunit and a first end of the second switch subunit are connected to the at least one drive unit, a second end of the first switch subunit is connected to the first display unit, a control end of the first switch subunit is connected to the first control signal line, a second end of the second switch subunit is connected to the second display unit, and a control end of the second switch subunit is connected to the second control signal line.

6. The display panel according to claim 5, wherein the first switch subunit comprises a first switch transistor and the second switch subunit comprises a second switch transistor; and a channel type of the first switch transistor and a channel type of the second switch transistor are the same.

7. The display panel according to claim 5, wherein in a same vertical blanking interval, a time when the first switch subunit is turned on lags behind a time when the second switch subunit is turned off, or a time when the second switch subunit is turned on lags behind a time when the first switch subunit is turned off.

8. The display panel according to claim 1, further comprising a first control signal line and a second control signal line, wherein the each gating switch unit comprises a first switch subunit and a second switch subunit; and a first end of each first switch subunit and a first end of each second switch subunit are connected to the at least one drive unit, a control end of each first switch subunit is connected to the first control signal line, second ends of i first switch subunits are connected to the at least one first display unit, and second ends of (n−i) first switch subunits are connected to the at least one second display unit; a control end of each second switch subunit is connected to the second control signal line, second ends of (n−i) second switch subunits are connected to the at least one first display unit, and second ends of i second switch subunits are connected to the at least one second display unit, wherein i is an integer greater than or equal to 1 and less than n, and n is a number of the at least one first display unit.

9. The display panel according to claim 8, wherein the at least one first display unit comprises at least one color display unit; the at least one second display unit comprises at least one color display unit; a type of the at least one color display unit of the at least one first display unit is same as a type of the at least one color display unit of the at least one second display unit; and each two color display units with a same type in the first display unit and the second display unit are connected to a same drive unit.

10. The display panel according to claim 1, further comprising a first control signal line and a second control signal line, wherein the each gating switch unit comprises a first switch subunit and a second switch subunit; and an array arrangement of the at least one first display unit is the same as an array arrangement of the at least one second display unit; and a first end of the first switch subunit and a first end of the second switch subunit are connected to the at least one drive unit; a control end of each first switch subunit is connected to the first control signal line, and a control end of each second switch subunit is connected to the second control signal line; each first display unit in an odd-numbered column is connected to a second end of a corresponding first switch subunit, and each first display unit in an even-numbered column is connected to a second end of a corresponding second switch subunit; and each second display unit in an odd-numbered column is connected to a second end of a corresponding second switch subunit, and each second display unit in an even-numbered column is connected to a second end of a corresponding first switch subunit; or each first display unit in an even-numbered column is connected to a second end of a corresponding first switch subunit, and each first display unit in an odd-numbered column is connected to a second end of a corresponding second switch subunit; and each second display unit in an even-numbered column is connected to a second end of a corresponding second switch subunit, and each second display unit in an odd-numbered column is connected to a second end of a corresponding first switch subunit.

11. The display panel according to claim 1, further comprising at least one data line, wherein the at least one data line is connected to the at least one drive unit in a one-to-one manner, and one of the at least one data line is configured to provide a first data signal and a second data signal for one of the at least one drive unit in a time-division manner.

12. The display panel according to claim 1, wherein the first display region is a region corresponding to a camera.

13. The display panel according to claim 1, wherein the first display unit is a light emission element, and the light emission element comprises a first electrode, a light emission layer, and a second electrode, wherein the first electrode, the light emission layer, and the second electrode are arranged in a stacked manner.

14. The display panel according to claim 1, wherein the second display region comprises a transition region and the transition region is a transition region for the first display region and a conventional display region.

15. The display panel according to claim 1, further comprising a third display region, wherein the third display region is at least partially disposed around the second display region, and the third display region is a conventional display region of the display panel.

16. The display panel according to claim 15, wherein a distribution density of the at least one first display unit in the first display region is the same as a distribution density of pixel units in the third display region.

17. The display panel according to claim 1, wherein the at least one drive unit is a 7T1C pixel circuit.

18. The display panel according to claim 15, wherein a luminous brightness of the at least one first display unit in the first display region is greater than a luminous brightness of pixel units in the third display region.

19. A display device, comprising the display panel according to claim 1.

* * * * *